US012290197B2

(12) United States Patent
Morris et al.

(10) Patent No.: US 12,290,197 B2
(45) Date of Patent: May 6, 2025

(54) STACKABLE CUSHIONS

(71) Applicant: LULULEMON ATHLETICA CANADA INC., Vancouver (CA)

(72) Inventors: Stephen Thomas Caulton Morris, Courtenay (CA); Colton Kai Yu, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 299 days.

(21) Appl. No.: 17/730,939

(22) Filed: Apr. 27, 2022

(65) Prior Publication Data

US 2023/0347203 A1 Nov. 2, 2023

(51) Int. Cl.
*A47G 9/10* (2006.01)

(52) U.S. Cl.
CPC ..... *A47G 9/10* (2013.01)

(58) Field of Classification Search
CPC .. A47G 9/10; A63B 21/4033; A63B 21/4037; A63B 21/4035; A63B 21/4039; A63B 23/1236; A63B 2208/0214
See application file for complete search history.

(56) References Cited

U.S. PATENT DOCUMENTS 1,677,122 A * 7/1928 Johnson ..... A63H 37/005 473/588
2,153,957 A * 4/1939 Davis ..... A63H 37/005 446/486
3,362,575 A * 1/1968 Fotos ..... B65D 21/0217 206/508
3,580,580 A * 5/1971 Wark ..... A63H 33/18 473/589
4,152,863 A * 5/1979 Kubiatowicz ..... A63H 37/005 446/486
4,212,131 A * 7/1980 Ross, Jr. ..... A63H 33/18 473/588
D260,492 S * 9/1981 Scott ..... D7/392.1
4,421,244 A * 12/1983 Van Melle ..... B65D 43/0212 206/508
4,889,347 A * 12/1989 Mineart ..... A63H 33/18 473/588
D342,027 S * 12/1993 Paulsen ..... D9/434
5,427,266 A * 6/1995 Yun ..... B65D 79/02 220/780

(Continued)

FOREIGN PATENT DOCUMENTS

CA 2510695 A1 * 12/2005 ..... A63B 21/0005

*Primary Examiner* — Myles A Throop

(57) ABSTRACT

Examples of stackable exercise cushions are disclosed. The cushions include a body and are defined by shaped top and bottom surfaces. The shaped top surface has a side-view profile with at least one concave portion and at least one raised portion adjacent to the at least one concave portion such that, from a top view of the body, the at least one raised portion is at a perimeter of the at least one concave portion. The shaped bottom surface has a side-view profile with at least one concave portion underneath the at least one raised portion of the shaped top surface, at least one convex portion underneath the at least one concave portion of the shaped top surface, and at least one flat portion such that, from a bottom view of the body, the at least one flat portion is at a perimeter of the shaped bottom surface.

19 Claims, 7 Drawing Sheets

(56) References Cited

U.S. PATENT DOCUMENTS

| | | | | | |
|---|---|---|---|---|---|
| 5,791,509 | A * | 8/1998 | Rush | B65D 43/0212 | 206/508 |
| D406,282 | S * | 3/1999 | Pinguelo | D21/443 | |
| D501,517 | S * | 2/2005 | Vodhanel, Jr. | A63H 33/18 | D21/443 |
| 7,500,900 | B2 * | 3/2009 | Wolfe, Jr. | A63H 33/18 | 446/460 |
| D725,714 | S * | 3/2015 | Kim | D21/443 | |
| D859,536 | S * | 9/2019 | Cope | D21/443 | |
| 10,525,372 | B2 * | 1/2020 | Fish | A63H 37/005 | |
| D875,024 | S * | 2/2020 | Zheng | D12/345 | |
| 2002/0017759 | A1 * | 2/2002 | McClung, III | A63H 33/18 | 119/51.01 |
| 2004/0192523 | A1 * | 9/2004 | Wu | A63B 21/4037 | 482/148 |
| 2008/0064289 | A1 * | 3/2008 | McAnulty | A63H 33/18 | 446/46 |
| 2021/0113886 | A1 * | 4/2021 | Van Curen | A63B 6/00 | |

* cited by examiner

STACKABLE CUSHIONS

FIELD OF INVENTION

This invention relates to exercise cushions and more particularly to stackable exercise cushions.

BACKGROUND OF THE INVENTION

Exercise mats, pads and cushions are often used during a variety of exercise activities that are conducted on a floor surface, such as yoga, Pilates and other training workouts. For example, a user may position a cushion on a hard floor or on an exercise mat to provide a more comfortable experience during various yoga poses or stretching exercises, by providing additional support to areas of the body such as hands, elbows, shoulders, feet, hips and knees. The user may also use stackable step platforms to provide height-adjustable support for various exercises and workouts.

Many step platforms are made of hard plastics and are uncomfortable against the hands, elbows, hips and knees of the user, while many cushions are not height-adjustable. Furthermore, cushions may slip or slide on a floor surface or on an exercise mat, causing the user to slip or fall.

Thus, there exists a need for exercise cushions that are stackable, and are less prone to slipping on a variety of surfaces, such as on mats and floors.

SUMMARY OF THE INVENTION

In various embodiments, the present disclosure provides cushions for use during a variety of exercise activities that provide additional support and comfort to areas of the body of a user. The cushions are also stackable such that a user may position two or more of the cushions as described herein together so as to provide support at varying heights. Furthermore, the cushions as described herein are shaped so as to create a partial vacuum, or suction, against a surface, thereby preventing slipping or sliding of the cushion on a floor, mat or other surface.

In one aspect, the present disclosure provides a cushion comprising: a body having a height and a width, and defined by a shaped top surface and a shaped bottom surface, the shaped top surface having a side-view profile along a cross-section of the body comprising at least one concave portion and at least one raised portion adjacent to the at least one concave portion, wherein, from a top view of the body, the at least one raised portion is at a perimeter of the at least one concave portion, and the shaped bottom surface having a side-view profile along the cross-section of the body comprising at least one concave portion underneath the at least one raised portion of the shaped top surface, at least one convex portion underneath the at least one concave portion of the shaped top surface, and at least one substantially flat portion, wherein, from a bottom view of the body, the at least one substantially flat portion is at a perimeter of the shaped bottom surface, wherein the side-view profile of the shaped bottom surface has a nesting fit with the side-view profile of the shaped top surface.

In various embodiments, and from the bottom view of the body, the shaped bottom surface is circular and the at least one substantially flat portion is around a circumference of the shaped bottom surface.

In various embodiments, the side-view profile of the shaped top surface further comprises a sloping edge toward the at least one substantially flat portion of the shaped bottom surface.

In various embodiments, the side-view profile of the shaped top portion comprises two raised portions, and two concave portions connected through a central raised portion, and the side-view profile of the shaped bottom portion comprises two concave portions and two convex portions connected through a central depressed portion.

In various embodiments, a height of the central raised portion is lower than a height of the two raised portions of the shaped top surface.

In various embodiments, a depth of the two concave portions of the shaped bottom surface is more than a depth of the central depression portion.

In various embodiments, the at least one convex portion of the shaped bottom surface and the at least one substantially flat surface are configured to engage with a surface.

In various embodiments, and from the top view of the body, the shaped top surface is rectangular and from the bottom view of the body, the shaped bottom surface is rectangular. The shaped top surface may comprise two top surface circular or oblong profiles, each of the two top surface profiles having the side-view profile along a cross-section of the top surface profile comprising the at least one concave portion and the least one raised portion adjacent to the at least one concave portion, wherein, from the top view of the body, the at least one raised portion is at the perimeter of the at least one concave portion of the top surface circular or oblong profile. The shaped bottom surface may comprise two bottom surface circular or oblong profiles, each of the two bottom surface profiles having the side-view profile along a cross-section of the bottom surface profile comprising the at least one concave portion underneath the at least one raised portion of the top surface profile, the at least one convex portion underneath the at least one concave portion of the top surface profile, and the at least one substantially flat portion for engaging with the surface, wherein, from the bottom view of the body, the at least one substantially flat portion is at the perimeter of the bottom surface circular or oblong profile.

In various embodiments, the cushion may be made of an elastomeric polymer, a rubber, a foam or any combination thereof. For example, the cushion may be made of ethylene vinyl acetate (EVA).

In various embodiments, the cushion may comprise one or more first zones and one or more second zones, wherein the one or more first zones are made of a material that is softer than a material of the one or more second zones. For example, the one or more first zones may be positioned at the at least one concave portion of the shaped top surface and the one or more second zones may be positioned at the at least one raised portion of the shaped top surface.

In various embodiments, the body comprises two or more different materials, wherein each of the two or more different materials have different densities. For example, at least one of the two or more different materials is engineered as a layer within the body.

In various embodiments, the body comprises one or more hollows.

In various embodiments, the cushion is an exercise support, a meditation pillow or a yoga block.

Other aspects and features of the present invention will become apparent to those of ordinary skill in the art upon review of the following description of specific embodiments of the invention in conjunction with the accompanying claims.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

In the accompanying drawings, which illustrate one or more exemplary embodiments.

DETAILED DESCRIPTION

Reference will now be made in detail to embodiments of the invention, examples of which are illustrated in the accompanying drawings. While the invention is described in conjunction with these embodiments, it will be understood that the descriptions herein are not intended to limit the invention to these embodiments. On the contrary, the invention is intended to cover alternatives, modifications, and equivalents that may be included within the scope of the invention as defined by the appended claims. Detailed description of components that are well known in the art may be omitted if that detailed description would confuse or obscure the description of the embodiments of the present invention.

In the context of the present disclosure, various terms are used in accordance with what is understood to be the ordinary meaning of those terms.

Directional terms such as "top", "bottom", "front", "back", "upper", "lower", "outer" and "inner" are used in the following description for the purpose of providing relative reference only, and are not intended to suggest any limitations on how any article or garment is to be positioned during use, or relative to an environment. The use of the word "a" or "an" when used herein in conjunction with the term "comprising" may mean "one", but it is also consistent with the meaning of "one or more", "at least one", and "one or more than one". Any element expressed in the singular form also encompasses its plural form. Any element expressed in the plural form also encompasses its singular form. The term "plurality" as used herein means more than one, for example, two or more, three or more, four or more, and the like.

The present disclosure provides a cushion for providing support and/or cushioning to a body part of a user during exercise, such as yoga, Pilates or meditation. In various embodiments, the disclosure provides cushions that provide support and are stackable, while minimizing slipping or sliding on a surface, such as on a floor or exercise mat. By having top and bottom surfaces of a particular shape, the cushions as disclosed herein may create a partial vacuum or suction against a surface so as not to slide or slip during use. In various embodiments, the cushion may be an exercise support, a meditation pillow or a yoga block.

Figure 1:
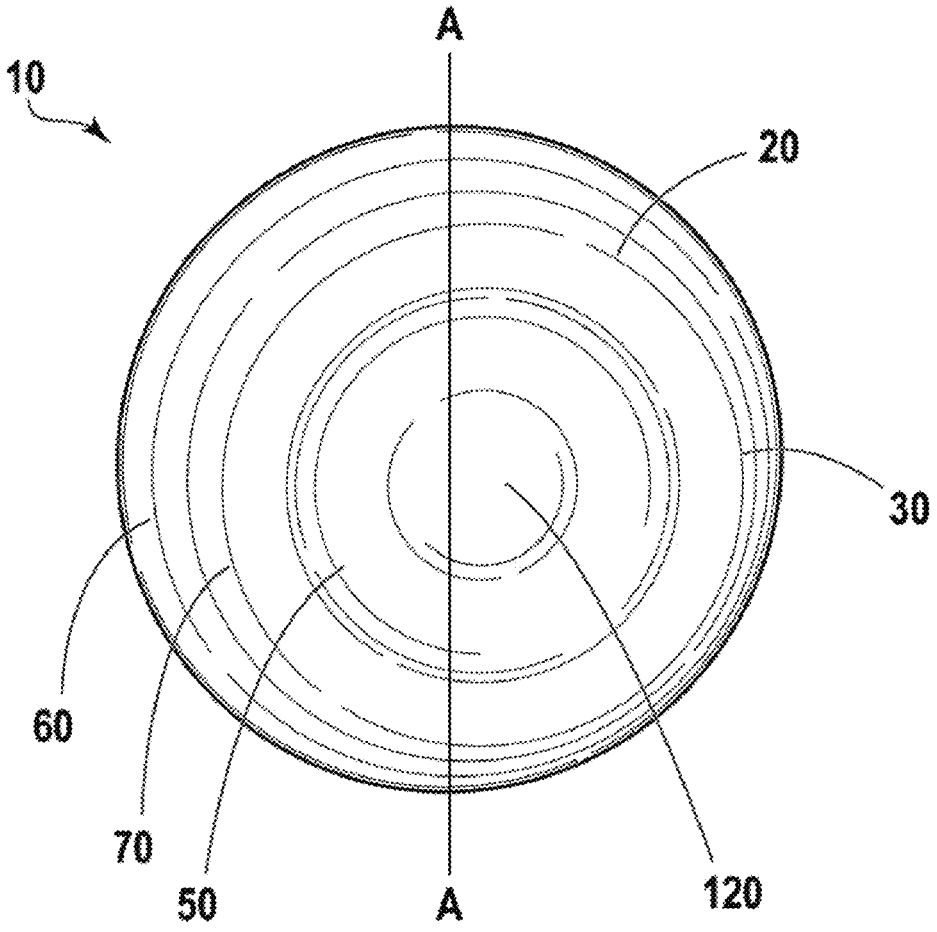
FIG. 1 is a top perspective view of a cushion according to an embodiment of the invention.
Figure 2:
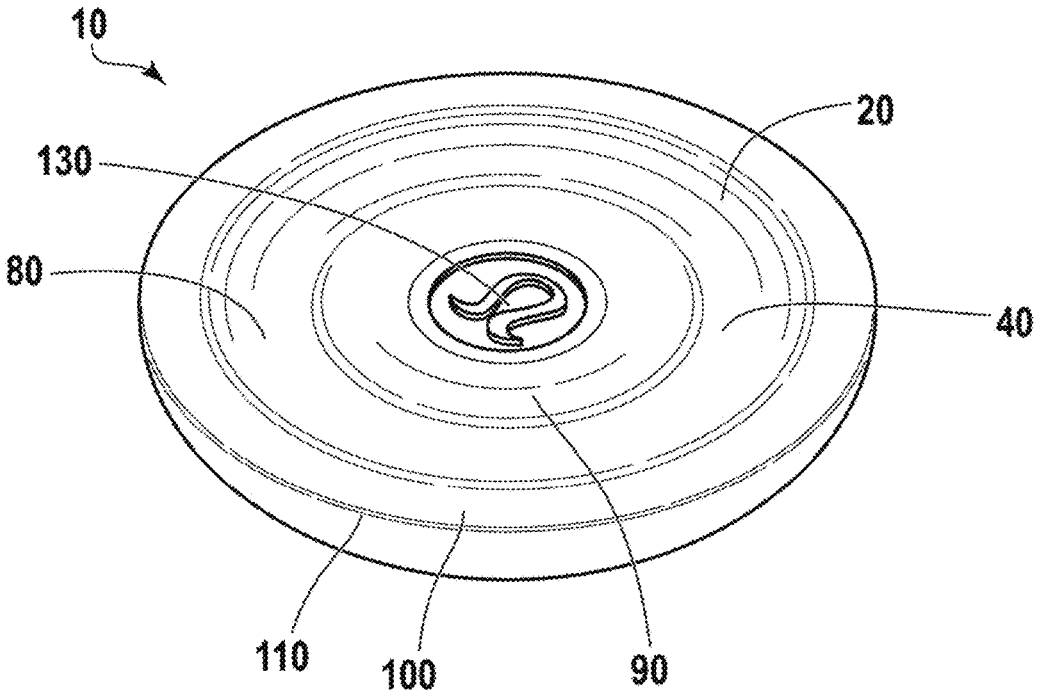
FIG. 2 is a bottom perspective view of a cushion according to an embodiment of the invention.

Referring to FIGS. 1 and 2, and according to a first embodiment of the disclosure, a cushion 10 is shown. The cushion 10 comprises a body 20 having a height and a width, and defined by a shaped top surface 30 and a shaped bottom surface 40.

Figure 3:
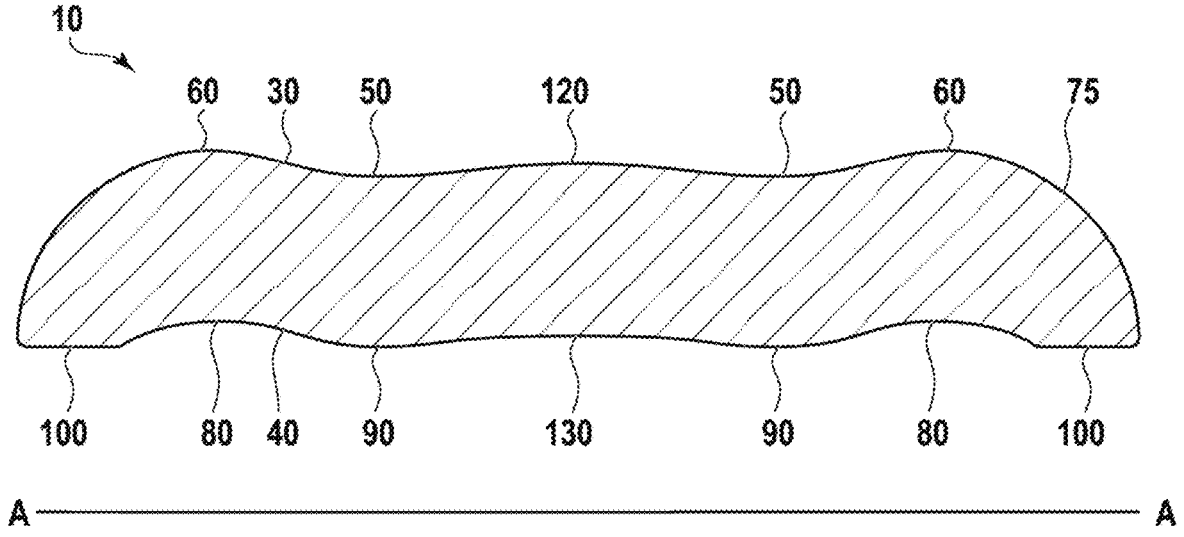
FIG. 3 is a cross-sectional view along A-A of the cushion according to the embodiment of the invention as shown in FIG. 1.

The shaped top surface 30 has a side-view profile along a cross-section of the body 20 (such as line A-A in FIG. 1) comprising at least one concave portion 50 and at least one raised portion 60 adjacent to the at least one concave portion 50, as shown in FIG. 3. As shown in FIG. 1, from a top view of the body 20, the at least one raised portion 60 is at a perimeter 70 of the at least one concave portion 50.

The shaped bottom surface 40 has a side-view profile along the cross-section of the body 20 comprising at least one concave portion 80 underneath the at least one raised portion 60 of the shaped top surface 30, at least one convex portion 90 underneath the at least one concave portion 50 of the shaped top surface 30, and at least one substantially flat portion 100. From a bottom view of the body 20, the at least one substantially flat portion 100 is at a perimeter 110 of the shaped bottom surface 40. The at least one substantially flat portion 100 is for creating a partial vacuum so that the cushion 10 may be suctioned to a surface, such as a floor or exercise mat. By creating a partial vacuum, the cushion is less likely to slip or slip on the surface during use by a user.

In various embodiments, the side-view profile of the shaped bottom surface 40 has a nesting fit with the side-view profile of the shaped top surface 30. The shaped top surface 30 is sized and designed such that the shaped bottom surface 40 is compatible to fit therein.

The side-view profile of the shaped top surface 30 may further comprise a sloping edge 75 toward the at least one substantially flat portion 100 of the shaped bottom surface 40.

In various embodiments and as is shown in FIG. 3, the side-view profile of the shaped top surface 30 along cross-section A-A of the body 20 may comprise two raised portions 60, and two concave portions 50 connected through a central raised portion 120. In such embodiments, the side-view profile of the shaped bottom portion 40 comprises two concave portions 80 and two convex portions 90 connected through a central depressed portion 130. A height of the central raised portion 120 may be lower than a height of the two raised portions 60 of the shaped top surface 30. A depth of the two concave portions 80 of the shaped bottom surface 40 may be more than a depth of the central depression portion 130. Such embodiments may be suitable for providing support or cushioning to a single body part of the user. In further embodiments, and depending on a shape of the cushion 10, the side-view profile of the shaped top surface 30 and the shaped bottom surface 40 may be different along different cross-sections. For example, along a first cross-section of the body 20, the side-view profile of the shaped top surface 30 may comprise two of the side-view profiles discussed above for FIG. 3, so as to provide two locations for supporting two body parts of the user, such as, for example, both hands, both elbows or both knees. Along a second cross-section perpendicular to the first cross section, the side-view profile may correspond to that of FIG. 3.

Figure 8:
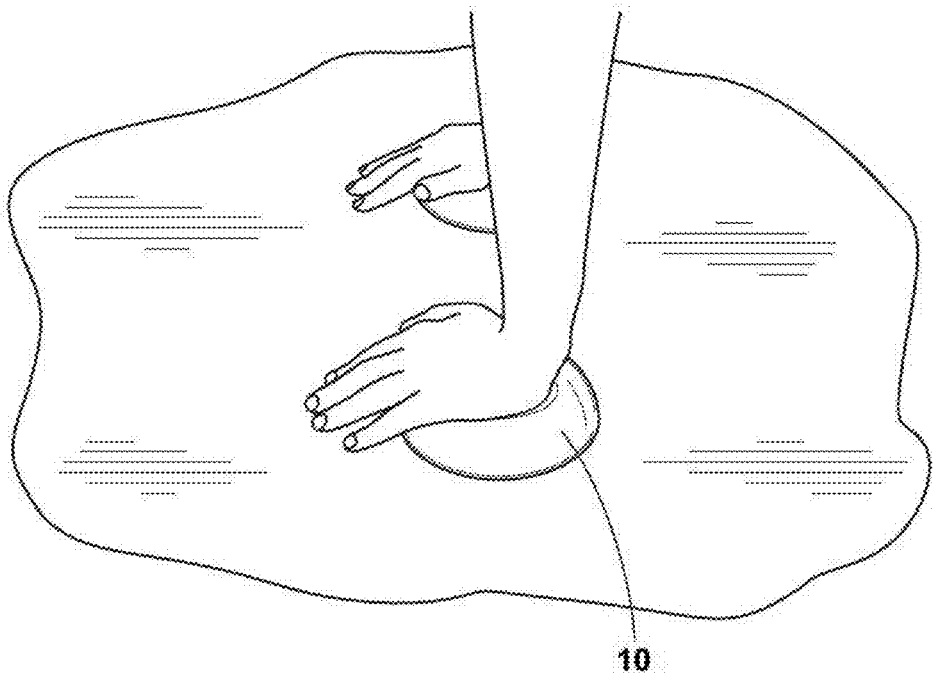
FIG. 8 is a photograph of a cushion according to an embodiment of the invention providing support to the hands of a user.
Figure 9:
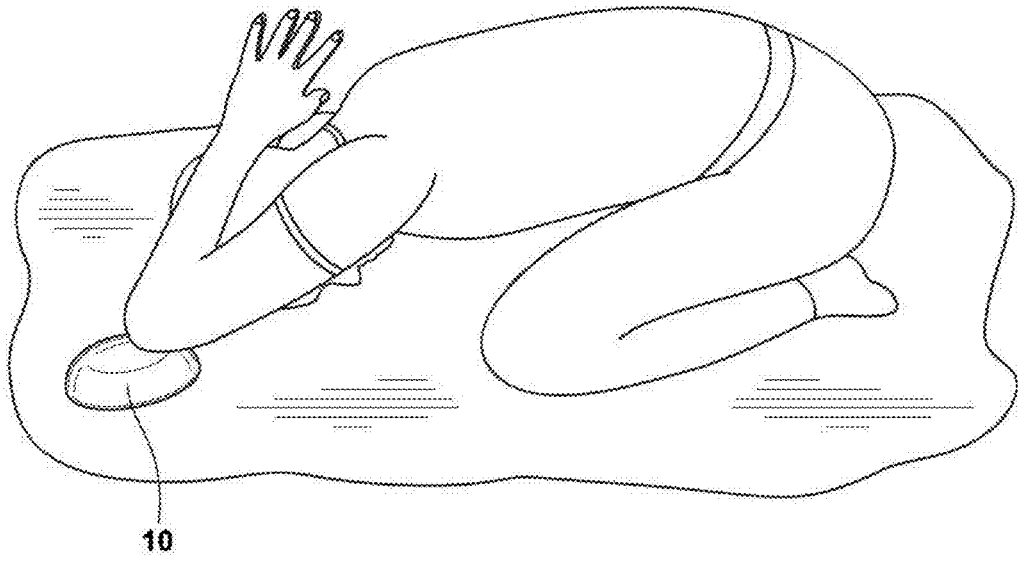
FIG. 9 is a photograph of a cushion according to an embodiment of the invention providing support to the elbows of a user.
Figure 10:
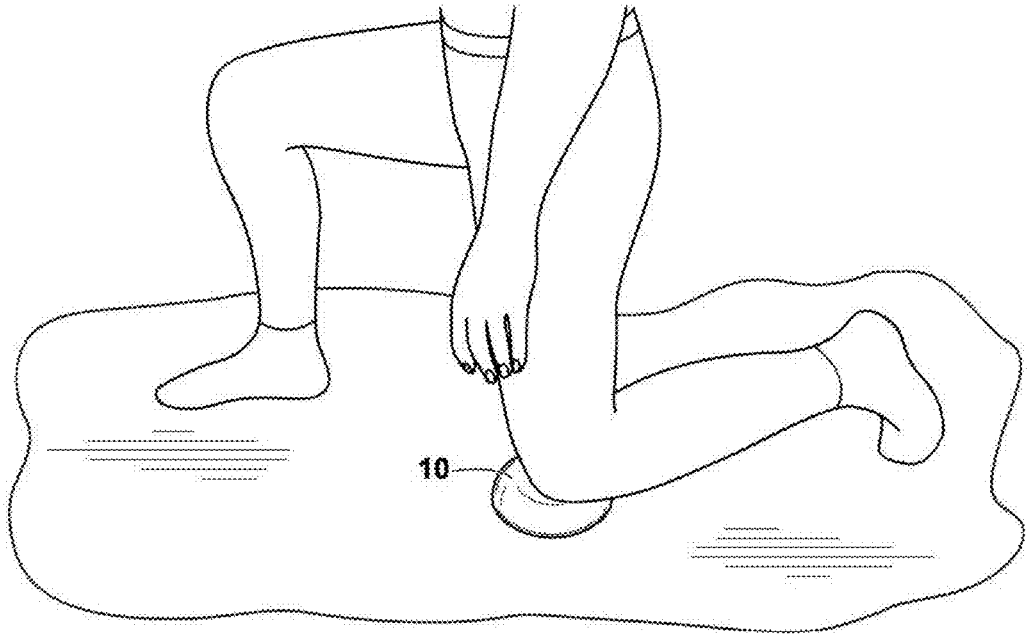
FIG. 10 is a photograph of a cushion according to an embodiment of the invention providing support to a knee of a user.

When the cushion 10 is placed on a surface, such as a floor or an exercise mat, the at least one substantially flat portion 100 of the shaped bottom surface 40 may engage with the surface. Alternatively, both the at least one convex portion 90 and the at least one substantially flat portion 100 of the shaped bottom surface 40 may engage with the surface. A partial vacuum may be created to hold the cushion 10 in place by the user pressing against the shaped top surface 30, such as at the raised central portion 120, so as to reduce the volume of space between the shaped bottom surface 40 and the surface, which causes the air between the shaped bottom surface 40 and the surface to be expelled, thereby reducing the pressure in the space. The partial vacuum is released as air leaks back into the space between the shaped bottom surface 40 and the surface. The cushion 10 as described herein is shown in use by the user in FIGS. 8-10, to provide support to the hands of the user (FIG. 8), the elbows of the user (FIG. 9) and a knee of the user (FIG. 10). Alternatively, the shaped top surface 30 may be placed on the surface and the at least one raised portion 60 engages therewith or both the at least one raised portion 60 and the central raised portion 120 engage therewith.

In various embodiments and as is shown in FIGS. 1 and 2, from a bottom view of the body 20, the shaped bottom surface 40 may be circular and the least one substantially flat portion 100 is around a circumference 110 of the shaped bottom surface 40. Likewise, from a top view of the body 20, the shaped top surface 30 may be circular. Alternatively, from a bottom view of the body 20, the shaped bottom surface 40 may be oblong and from a top view of the body 20, the shaped top surface 30 may be oblong.

In various embodiments, the cushion 10 may also be square or rectangular. In such embodiments, the shaped top surface 30 may comprises two or more top surface circular or oblong profiles, each of the two or more top surface profiles having the side-view profile comprising the at least one concave portion and the least one raised portion adjacent to the at least one concave portion, wherein, from the top view of the body, the at least one raised portion is at the perimeter of the at least one concave portion of the top surface circular or oblong profile, and the shaped bottom surface 40 comprises two or more bottom surface circular or oblong profiles, each of the two bottom surface profiles having the side-view profile comprising the at least one concave portion underneath the at least one raised portion of the top surface profile, the at least one convex portion underneath the at least one concave portion of the top surface profile, and the at least one substantially flat portion for engaging with the surface, wherein, from the bottom view of the body, the at least one substantially flat portion is at the perimeter of the bottom surface circular or oblong profile.

The cushions as disclosed herein may be made of a variety of materials so as to provide support and/or cushioning to body parts of the user. For example, the cushion 10 may be made of an elastomeric polymer, a rubber, a foam or any combination thereof. For example, the cushion may be made of ethylene vinyl acetate (EVA).

In various embodiments, the cushions may comprise different materials. For example, the cushion 10 may comprise one or more first zones and one or more second zones, and the one or more first zones are made of a material that is softer than a material of the one or more second zones. In this example, the one or more first zones may be positioned at the at least one concave portion 40 of the shaped top surface 30 and the one or more second zones are positioned at the least one raised portion 60 of the shaped top surface 30.

Figure 4:
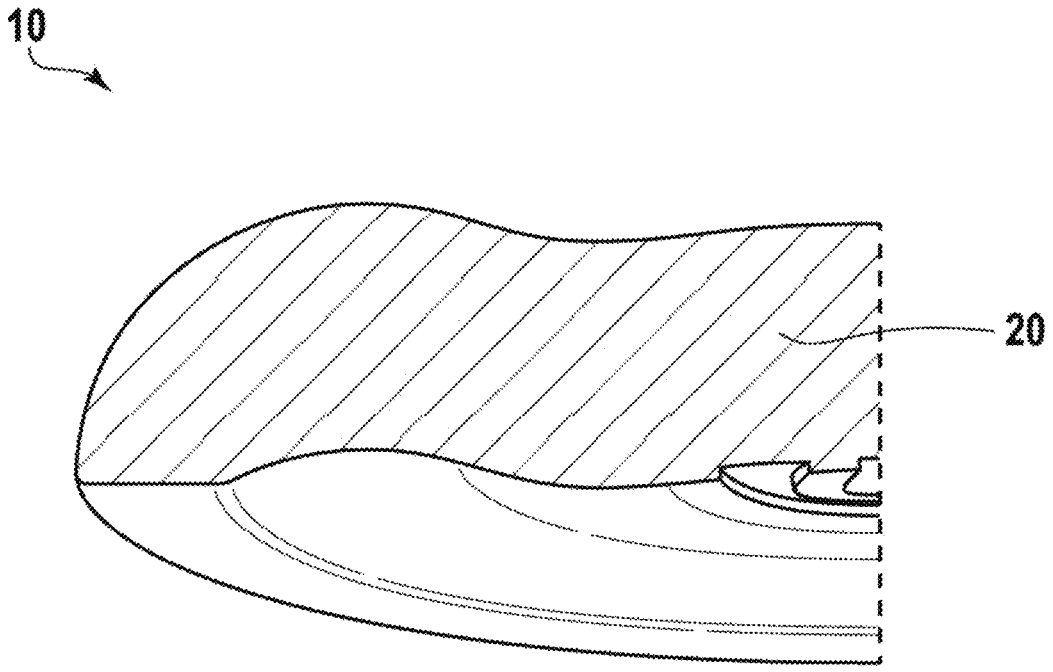
FIG. 4 is a plan view of an interior cross-section of a cushion according to an embodiment of the invention.
Figure 5:
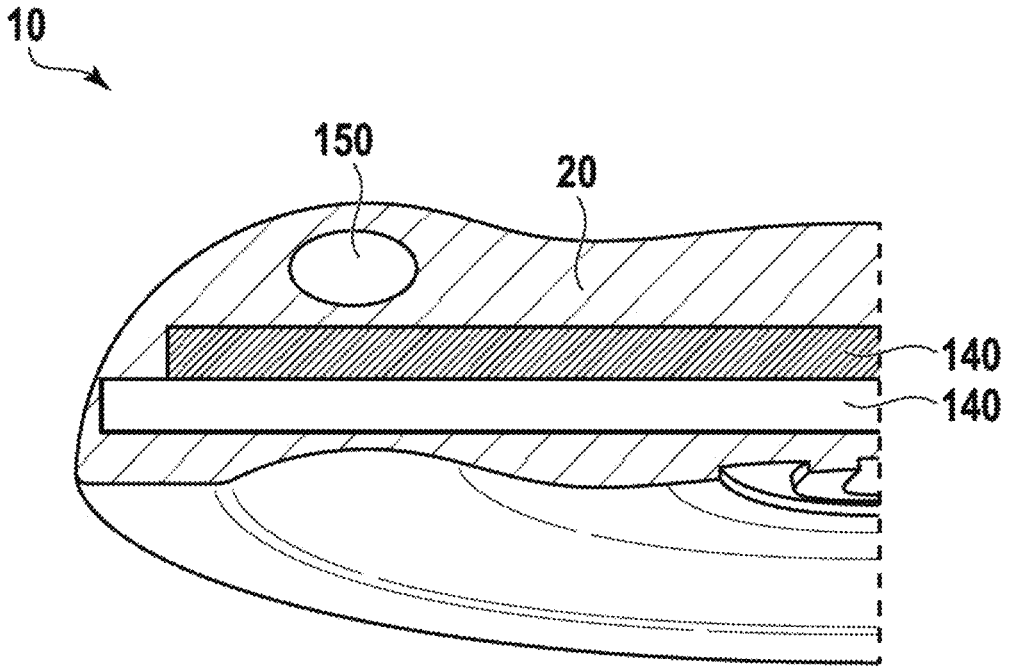
FIG. 5 is a plan view of an interior cross-section of a cushion according to a further embodiment of the invention.

The body 20 of the cushion 10 may comprise one material and an interior of the body 20 may be continuous, as shown in FIG. 4. Alternatively, and as shown in FIG. 5, the body 20 of the cushion 10 may comprise two or more different materials as layers 140 within the body 20. These different layers 140 may have different densities or firmness as compared to each other and thus, impact the level of cushioning or support provided by the cushion 10. The interior of the body 20 may also comprise one or more hollows 150, as shown in FIG. 5. In various embodiments, the cushion 10 may feel softer directly above these hollows 150. Thus, the cushion 10 may be modified to provide more or less support or cushioning to the user, depending on the activity being undertaken by the user and their preferences.

Figure 6:
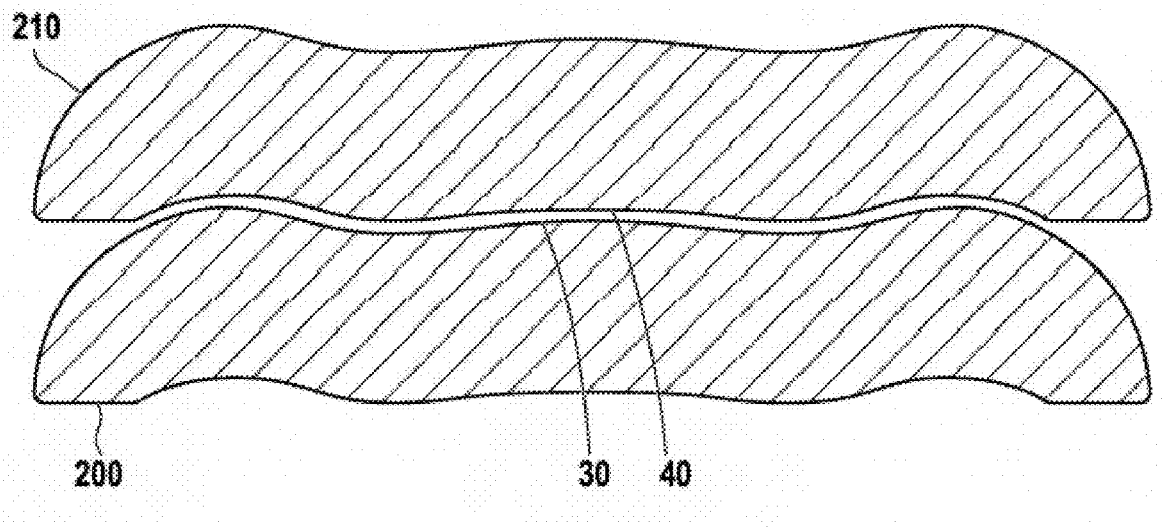
FIG. 6 is a cross-sectional view of two cushions stacked on top of each other with a shaped top surface of a first cushion adjacent to a shaped bottom surface of a second cushion.
Figure 12:
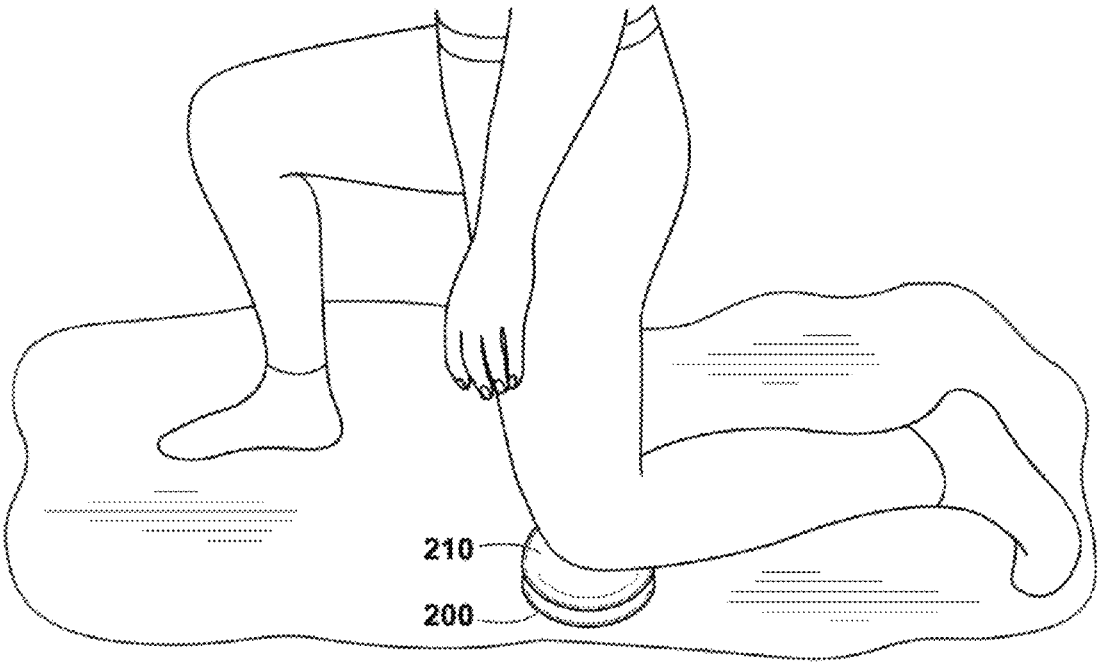
FIG. 12 is a photograph of two cushions according to an embodiment of the invention providing support to a knee of a user where a shaped bottom surface of a first cushion is adjacent to a shaped top surface of a second cushion.

The cushions 10 may be stacked in various ways to adjust a height of the support and/or cushioning provided to the user. For example, and as shown in FIG. 6, two cushions are stacked on top of each other with a shaped top surface 30 of a first cushion 200 adjacent to a shaped bottom surface 40 of a second cushion 210. In this embodiment, additional cushions may be stacked to adjust a height of the stack as desired by the user or for storage purposes. The shaped bottom surface 40 of the first cushion 200 may be pressed against a surface, such as a floor or exercise mat, to create a partial vacuum to hold the first cushion 200 in place, and thus, aid in preventing the user from slipping or sliding during use. This embodiment is shown in use in FIG. 12, as the stacked cushions provide support to a knee of the user.

Figure 7:
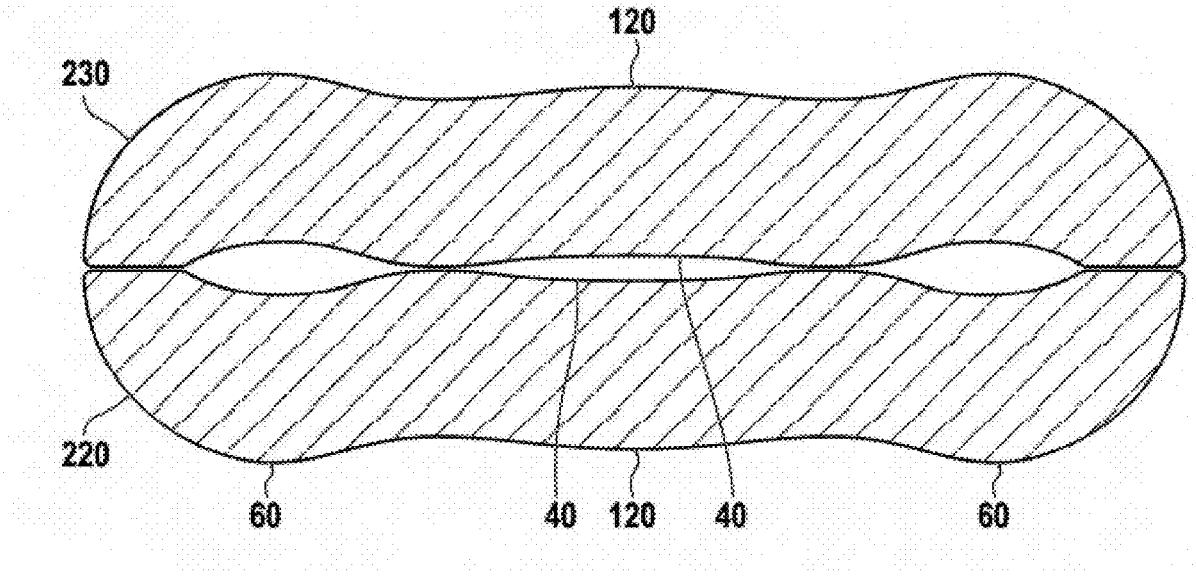
FIG. 7 is a cross-sectional view of two cushions stacked on top of each other with a shaped bottom surface of a first cushion adjacent to a shaped bottom surface of a second cushion.
Figure 11:
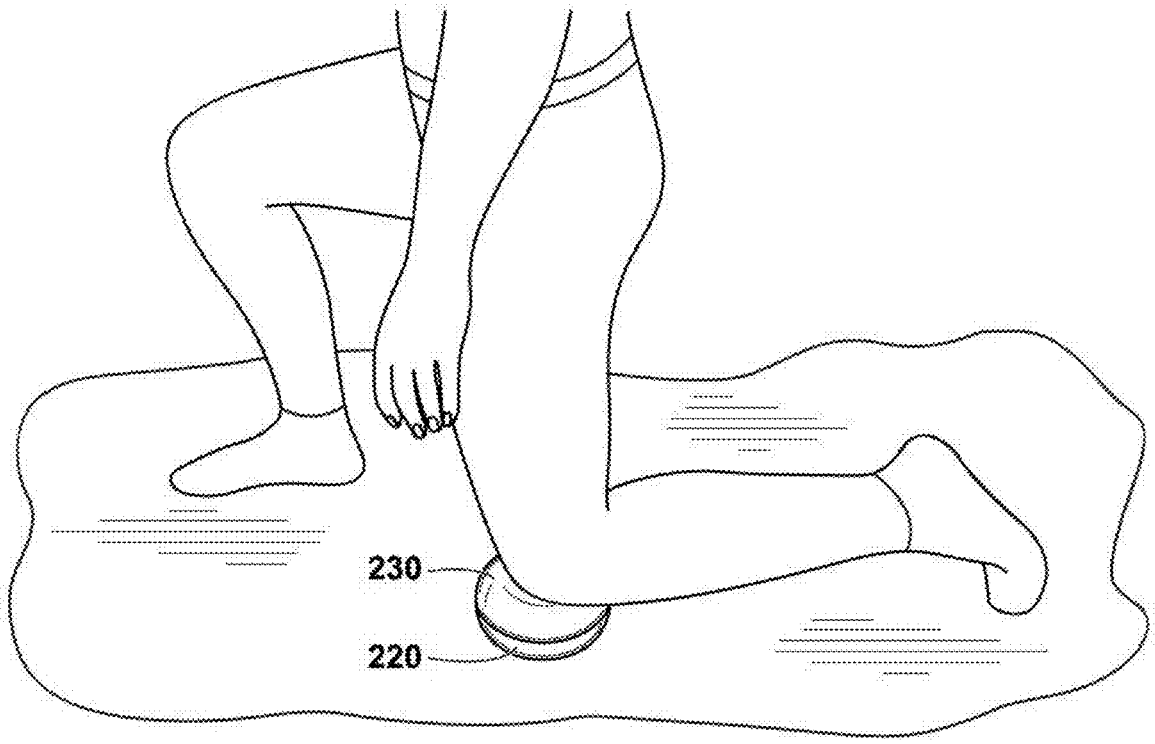
FIG. 11 is a photograph of two cushions according to an embodiment of the invention providing support to a knee of a user where a shaped bottom surface of a first cushion is adjacent to a shaped bottom surface of a second cushion.

As a further example, and as shown in FIG. 7, two cushions are stacked on top of each other with a shaped bottom surface 40 of a first cushion 220 adjacent to a shaped bottom surface 40 of a second cushion 230. In this embodiment, the at least one raised portion 60 of the first cushion 220 is in contact with the surface, such as a floor or mat, or both the at least one raised portion 60 and the central raised portion 120 of the first cushion 220 are in contact with the surface. A partial vacuum to hold the first cushion 220 in place and/or to hold the first and second cushions 220 and 230 together may be created by pressing on the shaped top surface 30, such as the central raised portion 120 of the second cushion 230. For example, when the two cushions are stacked shaped bottom surface 40 to shaped bottom surface 40 with their respective at least substantially flat portions 100 overlapping, they may be pressed together so as to create a partial vacuum therebetween, so that the two cushions are held together. This embodiment is shown in use in FIG. 11, as the stacked cushions provide support to a knee of the user.

Figure 13:
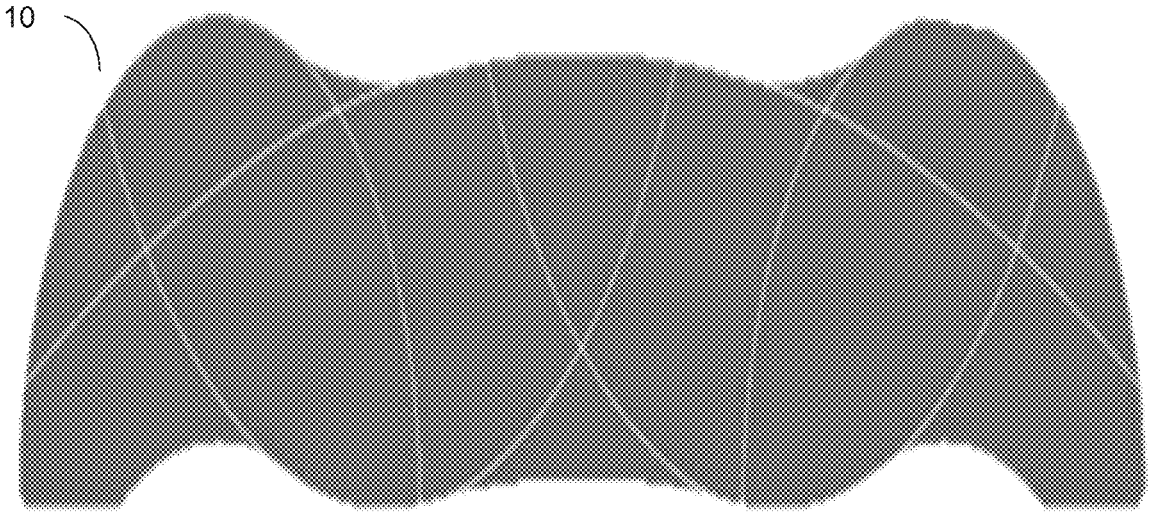
FIG. 13 is a cross-sectional view of a cushion according to a further embodiment of the invention

The cushions as disclosed herein may be of varying width or height, so as to accommodate various activities as undertaken by the user. For example, the cushion according to the embodiment as shown in FIG. 13 has a larger height and/or width than the embodiment shown in FIG. 3. The height of the cushion 10 may be about 25 mm, up to about 100 mm, with a width of about 100 mm to about 200 mm, such as about 140 mm, for example. A height between a top of the at least one raised portion 60 and a bottom of the at least one concave portion 50 of the shaped top surface 30 may be about 3.3 mm, for example. A height between the at least one substantially flat portion 100 and the at least one concave portion 80 of the shaped bottom surface 40 may also be about 3.3 mm, for example.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A cushion comprising:

a body having a height and a width, and defined by a shaped top surface and a shaped bottom surface, the shaped top surface having a side-view profile along a cross-section of the body comprising at least one concave portion and at least one raised portion adjacent to the at least one concave portion, wherein, from a top view of the body, the at least one raised portion is at a perimeter of the at least one concave portion, and the shaped bottom surface having a side-view profile along the cross-section of the body comprising at least one concave portion underneath the at least one raised portion of the shaped top surface, at least one convex portion underneath the at least one concave portion of the shaped top surface, and at least one substantially flat portion, wherein, from a bottom view of the body, the at least one substantially flat portion is at a perimeter of the shaped bottom surface, wherein the side-view profile of the shaped bottom surface has a nesting fit with the side-view profile of the shaped top surface, wherein the shaped top surface comprises two top surface circular or oblong profiles, each of the two top surface profiles having the side-view profile comprising the at least one concave portion and the least one raised portion adjacent to the at least one concave portion, wherein, from the top view of the body, the at least one raised portion is at the perimeter of the at least one concave portion of the top surface circular or oblong profile, and wherein the shaped bottom surface comprises two bottom surface circular or oblong profiles, each of the two bottom surface profiles having the side-view profile comprising the at least one concave portion underneath the at least one raised portion of the top surface profile, the at least one convex portion underneath the at least one concave portion of the top surface profile, and the at least one substantially flat portion for engaging with the surface, wherein, from the bottom view of the body, the at least one substantially flat portion is at the perimeter of the bottom surface circular or oblong profile.

2. The cushion of claim 1, wherein, from the bottom view of the body, the shaped bottom surface is circular and the at least one substantially flat portion is around a circumference of the shaped bottom surface.

3. The cushion of claim 1, wherein the side-view profile of the shaped top surface further comprises a sloping edge toward the at least one substantially flat portion of the shaped bottom surface.

4. The cushion of claim 1, wherein the side-view profile of the shaped top portion comprises two raised portions, and two concave portions connected through a central raised portion, and the side-view profile of the shaped bottom portion comprises two concave portions, and two convex portions connected through a central depressed portion.

5. The cushion of claim 4, wherein a height of the central raised portion is lower than a height of the two raised portions of the shaped top surface.

6. The cushion of claim 4, wherein a depth of the two concave portions of the shaped bottom surface is more than a depth of the central depression portion.

7. The cushion of claim 1, wherein the at least one convex portion of the shaped bottom surface and the at least one substantially flat surface are configured to engage with a surface.

8. The cushion of claim 1, wherein, from the top view of the body, the shaped top surface is oblong and from the bottom view of the body, the shaped bottom surface is oblong.

9. The cushion of claim 1, wherein, from the top view of the body, the shaped top surface is rectangular and from the bottom view of the body, the shaped bottom surface is rectangular.

10. The cushion of claim 1, wherein the cushion is made of an elastomeric polymer, a rubber, a foam or any combination thereof.

11. The cushion of claim 10, wherein the cushion is made of ethylene vinyl acetate (EVA).

12. The cushion of claim 1, wherein the cushion comprises one or more first zones and one or more second zones, wherein the one or more first zones are made of a material that is softer than a material of the one or more second zones.

13. The cushion of claim 12, wherein the one or more first zones are positioned at the at least one concave portion of the shaped top surface and the one or more second zones are positioned at the at least one raised portion of the shaped top surface.

14. The cushion of claim 1, wherein the body comprises two or more different materials, wherein each of the two or more different materials have different densities.

15. The cushion of claim 14, wherein at least one of the two or more different materials is engineered as a layer within the body.

16. The cushion of claim 1, wherein the body comprises one or more hollows.

17. The cushion of claim 1, wherein the cushion is an exercise support.

18. The cushion of claim 1, wherein the cushion is a meditation pillow.

19. The cushion of claim 1, wherein the cushion is a yoga block.

* * * * *